United States Patent [19]

Melgers

[11] Patent Number: 5,022,721

[45] Date of Patent: Jun. 11, 1991

[54] FURNITURE CONSTRUCTION SYSTEM

[76] Inventor: George Melgers, Postbud 50068, 1305 AB Almere, Netherlands

[21] Appl. No.: 328,222

[22] PCT Filed: May 24, 1988

[86] PCT No.: PCT/NL88/00024

§ 371 Date: Jan. 18, 1989

§ 102(e) Date: Jan. 18, 1989

[87] PCT Pub. No.: WO88/09136

PCT Pub. Date: Dec. 1, 1988

[30] Foreign Application Priority Data

May 22, 1987 [NL] Netherlands ..... 8701223

[51] Int. Cl.[5] ..... A47B 3/00

[52] U.S. Cl. ..... 312/257.1; 108/111

[58] Field of Search ..... 211/186, 187; 108/111; 312/306, 257 R, 198

[56] References Cited

U.S. PATENT DOCUMENTS

| | | | |
|---|---|---|---|
| 1,324,537 | 12/1919 | Belcher | 211/187 X |
| 1,427,249 | 8/1922 | Weston | 211/186 X |
| 2,347,821 | 5/1944 | Goldner | 211/186 |
| 3,132,609 | 5/1964 | Chesley | 108/111 X |
| 3,948,581 | 4/1976 | Helman et al. | 108/111 X |
| 4,540,222 | 9/1985 | Burrell | 211/186 X |

*Primary Examiner*—Joseph Falk

*Attorney, Agent, or Firm*—Edmund M. Jaskiewicz

[57] ABSTRACT

A furniture construction system has a pair of spaced vertical stands(13) supporting a plurality of shelves(8). Each stand has a pair of spaced profile columns and a longitudinal groove(3) in opposed faces of the columns. Spaced pin holes(4) are in the bottoms of the grooves and a distance block is in the opposed longitudinal grooves at similar heights and each block has a pin(5) received within a pin hole. A supporting beam(7) is on each pair of blocks and has a sideward extension(15). Each shelf rests on a sideward extension and has a thickness equal to the distance between the upper surfaces of the beam and the sideward extension thereon.

11 Claims, 5 Drawing Sheets

FURNITURE CONSTRUCTION SYSTEM

FIELD OF THE INVENTION

This invention pertains to a variable furniture construction system and more in particular to a wooden (dis)mountable, variable furniture construction system that, in mounted condition, comprises at least two vertical stands, each consisting of a pair of columns, said system further comprising a number of in height adjustable trays, which in mounted condition are lying horizontally, said trays being carried at their ends by detachable supporting beams attached to the stands.

BACKGROUND OF THE INVENTION

Until the present a number of different such-like construction systems have been proposed. These on the one hand have the disadvantage that for mounting use is made of, from the outside clearly visible, esthetically unsightly metal parts and/or series of bore holes, as a result of which the mounted system is less suited to be applied for a true furniture function. On the other hand such systems consist of components connected to each other thus that an insufficient sturdy construction is achieved, which more in particular in the long run proves not to endure the normally occurring heavy stress. If the known system is used for books, a sufficiently sturdy mounted system can be realized only by additional means requiring a rather complicated and elaborate mounting.

Subsequently there is still demand for a simple and financially attractive system of a predominantly wooden furniture construction which is easy to mount and dismount, that is truly acceptable from an esthetic point of view as a piece of furniture thanks to the lack of visible unsightly metal parts and/or series of bore holes.

SUMMARY OF THE INVENTION

Purpose of the invention is therefore to provide a financially attractive and easy to mount, variable furniture construction system, that moreover meets the demand described in the above. According to the invention such a predominantly wooden furniture construction system is distinguished in that each profile column provided on the inward facing side with a groove in the longitudinal direction, in the bottom of which a number of mutually spaced pin holes have been made into which pins of distance blocks fit, whereby each time on two opposite distance blocks attached at similar height, a supporting beam is positioned, on which one end of a tray rests, whereby each supporting beam is provided on the side directed to the thereupon resting tray, with recessed pin holes or protruding pins, while in the surface of the place-tray in the place of these pin holes or protruding pins respectively corresponding fitting pins or pin holes are provided in order to strengthen the mounted system further on.

DESCRIPTION OF THE DRAWINGS

FIG. 1 shows in perspective the upper portion of a stand, comprising two profiled columns and one end of a tray.

Figure 4:
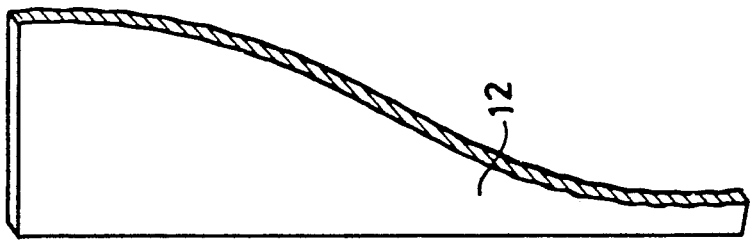
Figure 3:
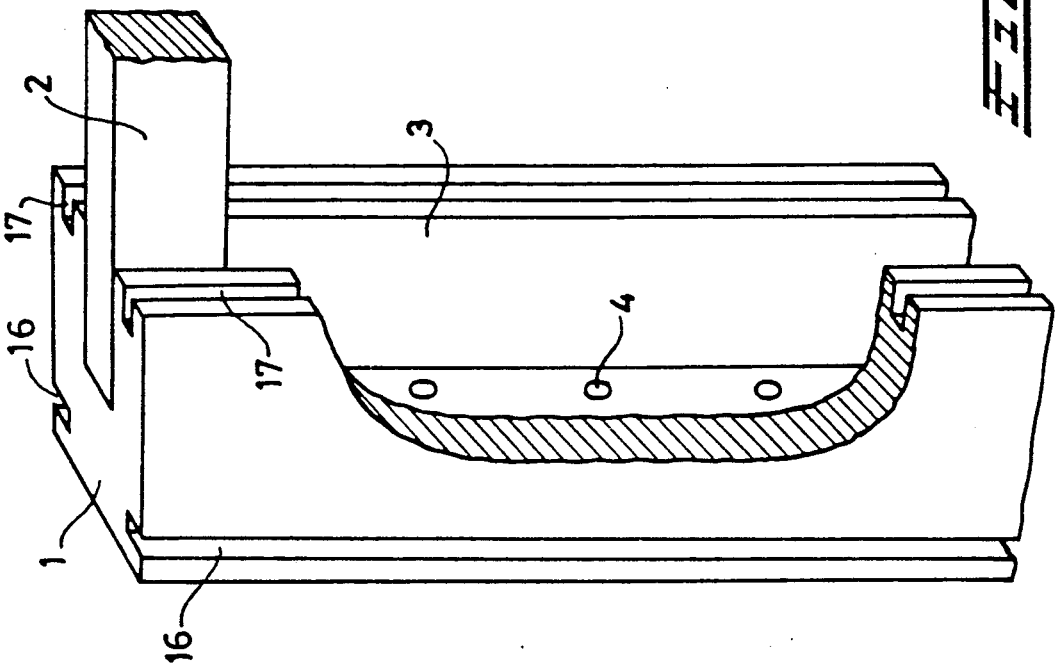
Figure 2:
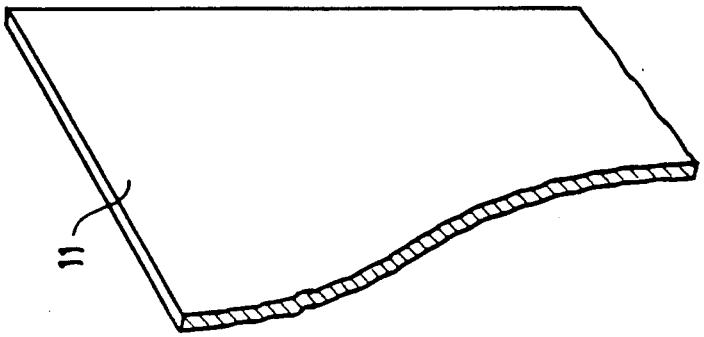

The FIGS. 2-4 are a partly exploded view of the upper portion of one column, partly cut-out with a small part of a side panel and a back panel.

Figure 5:
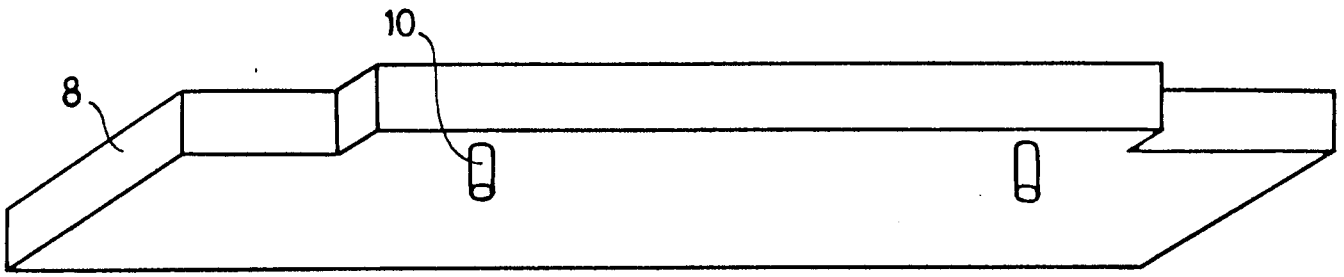

FIG. 5 is a perspective front view of a portion of a tray.

Figure 6:
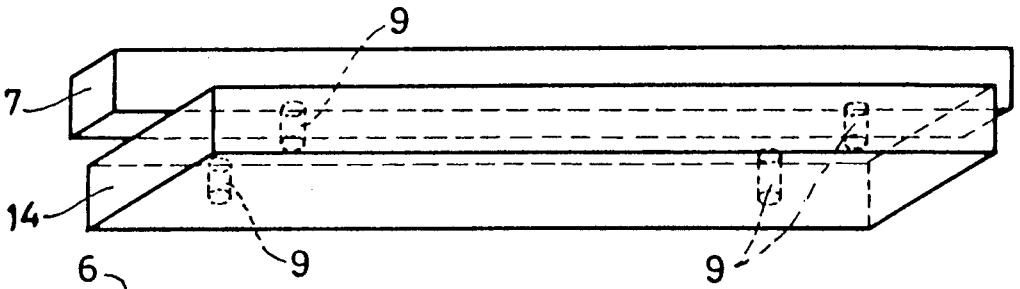

FIG. 6 shows a supporting beam with a separate wing-shaped sideward extension.

Figure 7:
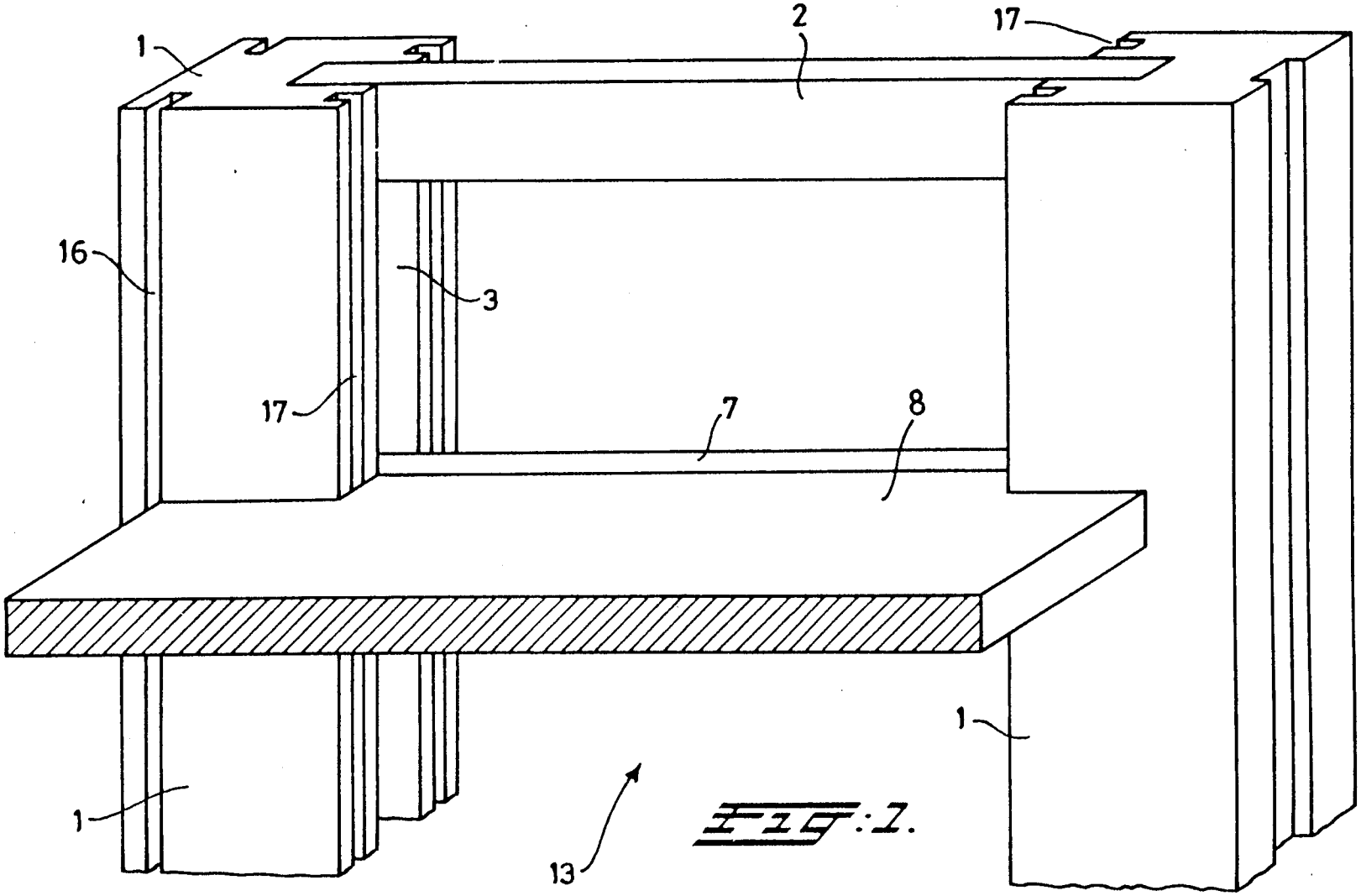
Figure 8:
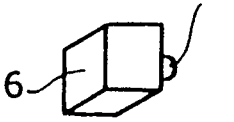
Figure 7:
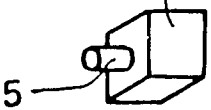

The FIGS. 7 and 8 show two opposite distance blocks for carrying a supporting beam.

Figure 10:
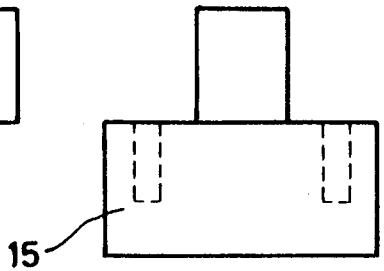
Figure 5:
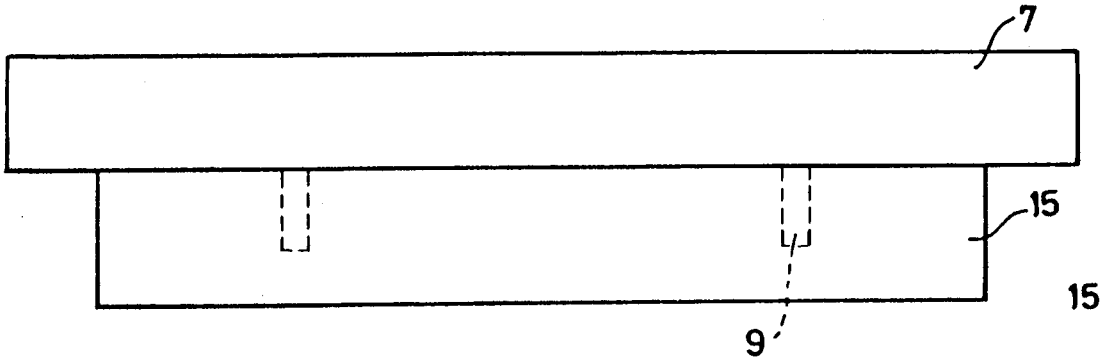
Figure 11:
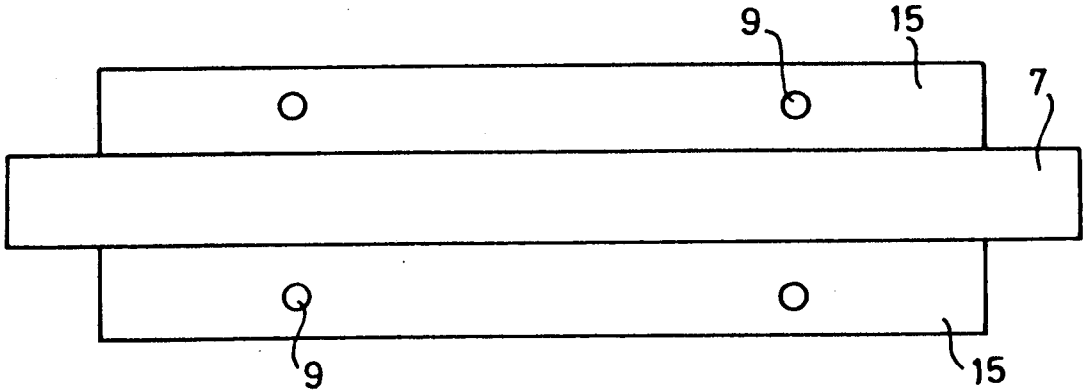
Figure 15:
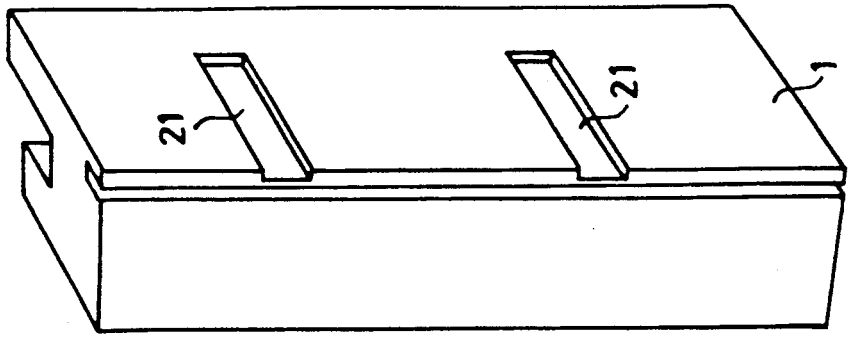

The FIGS. 9-11 show three different views of an integrated combination of a supporting beam having on both sides a wing-shaped extension.

The FIGS. 12-15 are four different embodiments of a column belonging to a vertical stand.

DESCRIPTION OF PREFERRED EMBODIMENTS

As can be seen from FIG. 1, a stand 13 for the present furniture construction system is composed of two spaced profile columns 1, interconnected at the top by a cross-beam 2. At the invisible bottom of the stand 13, there is another cross-beam. Each column 1 has a longitudinal groove 3 into which the cross-beams 2 are secured. FIG. 3 shows a number of spaced holes 4 in the bottom of the groove 3. Into these holes 4 a pin 5 of a distance block 6 (shown in FIGS. 7 and 8) may be inserted. Upon a pair of blocks 6 mounted into the grooves 3 of two spaced columns 1 belonging to the same stand 13, both blocks lying on the same level, a supporting beam 7 can be laid, for carrying one end of a tray 8.

The width of the groove 3 in the inner side of each vertical profile beam 1 of the stand 13 must correspond as closely as possible to the width of the distance blocks 6 in order to give a mounted furniture construction system the maximum sturdiness. The end of each tray 8 has on its underside two protruding pins 10 to fit into corresponding pin holes or recesses 9 in the upper surface of an element 14 (FIG. 6) secured to the lower face of the supporting beam 7. The design also covers an embodiment in which the underside of the tray 8 is provided with the holes or recesses 9 into which corresponding protruding pins 10 fit, projecting from the upper side of the element 14. In a simplified embodiment (not shown) the holes 9 or pins 10 can be made directly into the upper face of the beam 7, rendering the element 14 superfluous.

In a preferred design of the furniture construction system according to the invention, the aforementioned pin holes 9 in the beam 7 or in the element 14 are made in the upper surface of a wing-shaped sideward extension 15 (FIGS. 9-11), of which the upper surface is lying flush with, or lower than the upper surface of the beam 7. Preferably the extension 15 is situated so much lower that in mounted condition the upper side of the tray 8 and the upper surface of the beam 7 is lying flush, as shown in FIG. 1.

The intended extension 15 can for instance be achieved simply be securing a plate in the longitudinal direction against the bottom wall of the beam 7. Such a design form is illustrated in FIGS. 9-11.

The pins 5 in the distance blocks 6 and the pins 10 on the under side of each tray 8 can in principle be manufactured from different suitable materials with sufficient strength, such as plastics or metals, especially selected for that purpose. The pins shall preferably be made of metal.

The protruding pins shall suitably have a diameter of 3-8 mm and preferably of 4-6 mm, and a length of 6-15 mm and preferably of 8-10 mm.

The pin holes 4 and 9 will have the same shape and dimensions so that these can be made in one standard operation, for instance by boring to a depth of 7-16 mm and preferably of 9–11 mm. The distance blocks can be made of different suitable, shape-retaining materials with low thermal expansion, such as certain plastics or wood. Most suitably the distance blocks are made in wood and fitted with a metal pin or if, forming one unit, a molded piece of a suitable plastic.

Figure 13:
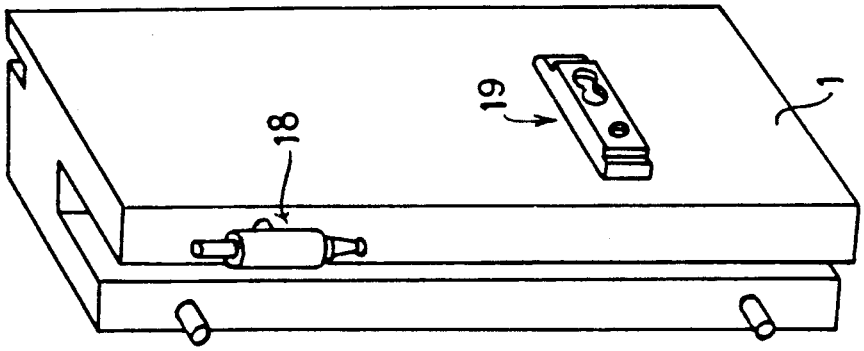
Figure 12:
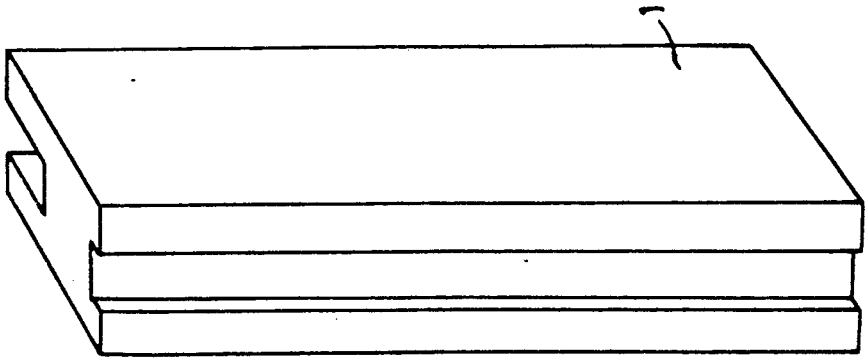

According to a preferred design form of the furniture construction system, there are extra grooves 16 and 17 in the vertical profile column in order to place a back-panel 11 and/or a side-panel 12, respectively, as illustrated in FIGS. 2–4. In FIG. 12 the most simple column 1 is shown. FIG. 13 shows a further preferable design form of the furniture construction system in which the profile column 1 of a stand 13 has, on its front and/or the side, been provided with hinges 18, 19 different in size and sorts, on which doors of different measurements can be hanged.

Figure 14:
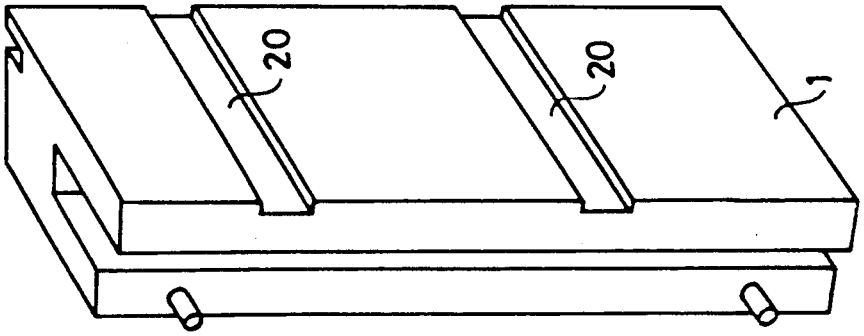

According to another preferred design form shown in FIG. 14 of the furniture system, a profile column 1 with grooves 20 can be used on the front side of a stand 13. A profile column 1 shown in FIG. 15 can be used on the back of the same stand, comprising grooves 21 so that several types of drawer leadings can be attached. It will be evident that a combination of two profile columns 1 of the type shown in FIGS. 13–15 can be united by a panel 11 or 12.

In this way total closed parts of bookcases, cupboards, etc. arise. It is also evident that to the furniture system belong closed cupboards, bookcases, cupboards with drawers etc., all of them adapted to be locked. Preferably the design form of the profile column according to FIG. 13, complete with hinges construction, is performed such, that the doors, being hanged on this beam, can fall within the frame at the front side of the furniture system, in order to get a smooth front.

The hinges 18, 19 for eventually used doors, may be attached to the frontside, inner side respectively, of the profile column 1, depending on the type of hinge.

The drawers (not shown), used for the furniture described before, can totally be made of wood whereby different parts can, if desirable, be made of different sorts of wood. Also the part of the drawer, shoven into the furniture construction system, can be made of a selected suitable plastic, whereby the front of the drawer can be covered with wood.

For the purpose of a maximal strength of the mounted furniture system, the clearance between the pins 5 and 10 and the pinholes 4 and 9 respectively is, in the wooden parts, as small as possible.

It will be evident that the components of the furniture construction system according to the invention, can be manufactured very simply and quickly, and in large series, and therefore in a financially attractive manner with the aid of suitable equipment for such purposes, while for the furniture construction system under consideration the following other advantages can be combined:

a. from the outside only wood is visible on the mounted system, thus offering an important advantage from an esthetical point of view;
b. as a result of the applied manner of assembly, which is relatively fast and easy, a sturdy construction is realized;
c. this furniture system can, without expensive and supplementary labour on the most essential parts, be equipped with real furniture supplies as there are doors and drawers, the measures of which are not limited to the standard measures.
d. thanks to easy mounting and dismounting the arrangement of the desired furniture construction system is simple to alter according to wish, depending on the ever changing user requirements;
e. because of the great variation possibilities with regard to the dimensions of the component parts, the furniture construction system is greatly variable in height and width.

The invention also pertains to the characteristic separate parts of the furniture construction system described above, and more in particular to the stands 13, fitted with the vertical profile columns 1, the distance blocks 6, the supporting beams 7, and the trays 8 with pins 10.

What is claimed is:

1. A wooden furniture construction system comprising a pair of spaced vertical stands (13) for supporting therebetween a plurality of vertically spaced parallel horizontal shelves (8), each of said stands comprises a pair of spaced mirror symmetrical profile columns (1) having opposed faces directed toward each other, there being a longitudinal groove (3) in each of said opposed faces and each said longitudinal groove having a bottom, there being a plurality of mutually spaced pin holes (4) in the bottom of each said groove, a block (6) disposed in each of said opposed longitudinal grooves of each of said stands at similar heights, each of said blocks having a pin (5) received within a said pin hole, a supporting beam (7) positioned on each of said pairs of blocks and having a sideward extension (15) in the longitudinal direction of a said beam extending between the stands each said sideward extension having an upper surface spaced below the upper surface of said beam, a said shelf (8) disposed upon the upper surfaces of said sideward extensions of a pair of beams, said shelf having a thickness equal to the distance between the upper surfaces of said beam and said sideward extension thereon.

2. A wooden furniture construction system as claimed in claim 1 wherein there are second pin holes (9) in said upper surface of each said sideward extension, there being downwardly extending pins (10) on an underside of a said shelf correspondingly positioned to be received within said second pin holes.

3. A wooden furniture construction system as claimed in claim 1 wherein said shelf has an upper surface flush with the upper surface of said supporting beam.

4. A wooden furniture construction system as claimed in claim 2 wherein said pins are cylindrical and have a diameter of 3–8 mm. and have a length of 6–15 mm.

5. A wooden furniture construction system as claimed in claim 4 wherein said pins have a diameter of 4–6 mm. and a length of 8–10 mm.

6. A wooden furniture construction system as claimed in claim 1 wherein said blocks are of wood and have metal pins.

7. A wooden furniture construction system as claimed in claim 1 wherein the vertical profile columns on the same sides of said pair of vertical stands have hinges thereon and doors hung on said hinges.

8. A wooden furniture construction system as claimed in claim 1 wherein there are opposed grooves in the inner surfaces of each of said pair of opposed vertical columns of said pair of vertical stands for mounting drawer slides therein.

9. A wooden furniture construction system as claimed in claim 7 wherein said hinges each have at least one pin received within a hole in a said vertical column for mounting said hinges thereon.

10. A wooden furniture construction system as claimed in claim 1 wherein there are second longitudinal grooves in said opposed faces of said profile columns and a side panel positioned in said second grooves.

11. A wooden furniture construction system as claimed in claim 1 wherein there are third longitudinal grooves in the opposing faces of a pair of opposed vertical columns in said pair of vertical stands and a back panel positioned in said third grooves.

* * * * *